US006895627B1

(12) United States Patent
Lin

(10) Patent No.: US 6,895,627 B1
(45) Date of Patent: May 24, 2005

(54) BLACKBOARD ERASER

(76) Inventor: Chieh-Jen Lin, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/768,121

(22) Filed: Feb. 2, 2004

(51) Int. Cl.[7] ..... A47L 13/38; B43L 21/00

(52) U.S. Cl. ..... 15/98; 15/27; 15/210.1; 15/221; 434/417

(58) Field of Search ..... 15/98, 114, 210.1, 15/221, 27; 434/417

(56) References Cited

U.S. PATENT DOCUMENTS

| | | | | |
|---|---|---|---|---|
| 1,487,052 A | * | 3/1924 | Enomoto | 15/210.1 |
| 3,160,163 A | * | 12/1964 | Bolinger | 132/258 |
| 4,232,871 A | * | 11/1980 | Horian et al. | 15/1.52 |
| 4,642,835 A | * | 2/1987 | Schmitz | 15/104.002 |
| 4,742,594 A | * | 5/1988 | Chen | 15/98 |
| 4,941,225 A | * | 7/1990 | Liao | 15/98 |

FOREIGN PATENT DOCUMENTS

| | | | |
|---|---|---|---|
| GB | 2090123 | * | 7/1982 |

* cited by examiner

*Primary Examiner*—Randall Chin

(57) ABSTRACT

A blackboard eraser including a cube having two semi-cylindrical grooves symmetrically arranged in a longitudinal direction therein, and a central brush atop an elevated surface formed between the two grooves. A longitudinal groove is defined underneath each of the send-cylindrical grooves, and equal-length side brushes, which are affixed to an inner surface of a lid, are respectively positioned in the longitudinal grooves. Two grooves are arranged adjacent to each end of the semi-cylindrical grooves, which provide for a shaft affixed to each end of a roller to dispose therein. The brushes and the rollers form the eraser, which are enclosed within a closed chamber between the lid and the two semi-cylindrical grooves. When erasing chalk dust from a blackboard, the chalk dust sticks to the rollers and is carried to the side brushes. The side brushes then wipes the dust, which falls into the closed chamber.

1 Claim, 6 Drawing Sheets

BLACKBOARD ERASER

BACKGROUND OF THE INVENTION (a) Field of the Invention

The present invention relates to a blackboard eraser, and more particularly to an improved structure which is easy-to-use, easy-to-empty, and easy-to-disassemble for cleaning.

(b) Description of the Prior Art

A conventional blackboard eraser is generally made from cloth material, and causes a cloud of dust to form when erasing a blackboard and when cleaning the surface of the cloth material by tapping, which can be adverse to the health and environment.

SUMMARY OF THE INVENTION

In view of the foregoing shortcomings inherent in a conventional blackboard eraser, the present invention provides an unproved structure, which is easy-to-use, easy-to-empty, and easy-to-disassemble for cleaning.

The primary structure of the present invention is a cube having two symmetrically arranged semi-cylindrical grooves formed in a longitudinal direction therein, and a central brush is affixed to an elevated surface formed between the two grooves. A longitudinal groove is defined underneath each of the semi-cy positioned in each of the longitudinal grooves. Two grooves are arranged adjacent to each end of the semi-cylindrical grooves, and provide for shafts of each roller to dispose therein. The brushes and the rollers thereby form the eraser. When the blackboard eraser is rolling on a blackboard, chalk dust sticks to the rollers, thus erasing the blackboard is made more convenient and cleaner. Moreover, the rollers carry the chalk dust to the side brushes, which wipe the dust, and the dust thus falls into a closed chamber. To clean the accumulated dust, the lid is opened and the dust is emptied out from the chamber, thereby correcting shortcomings of harmful dust flying in the air when tapping the cloth surface of traditional erasers.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
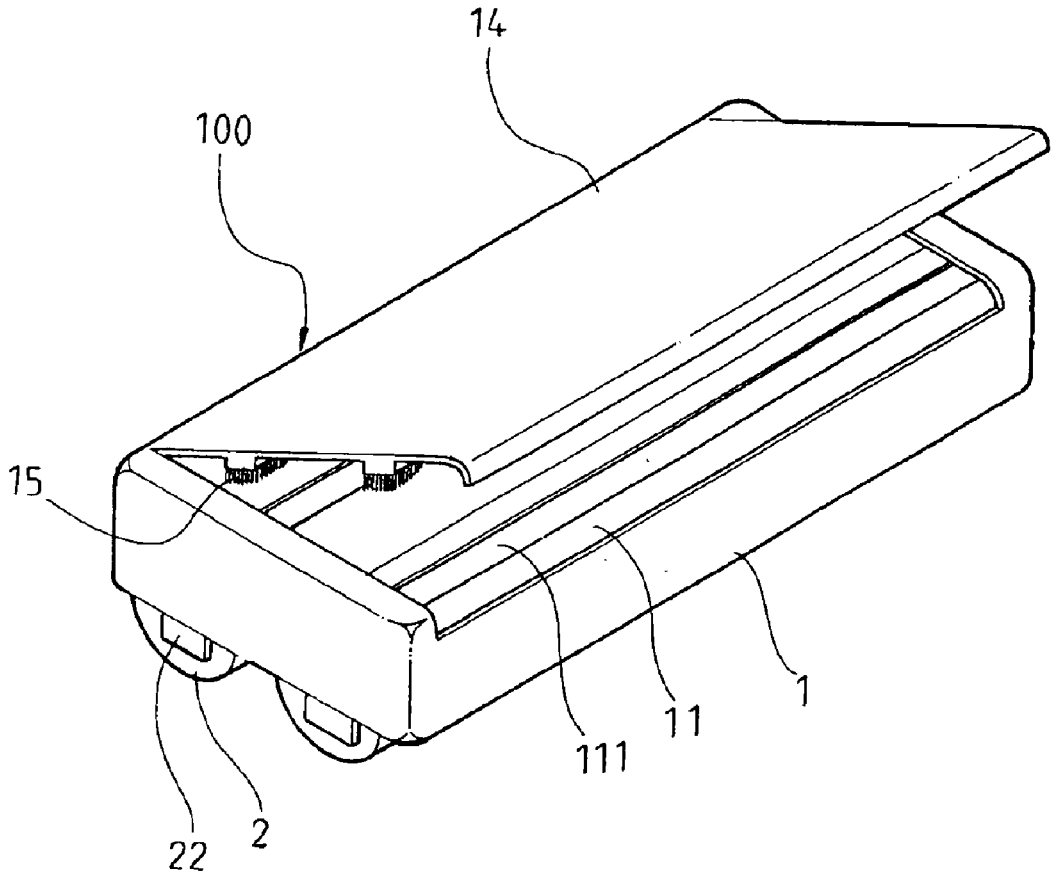
FIG. 1 shows a perspective view of the present invention.
Figure 2:
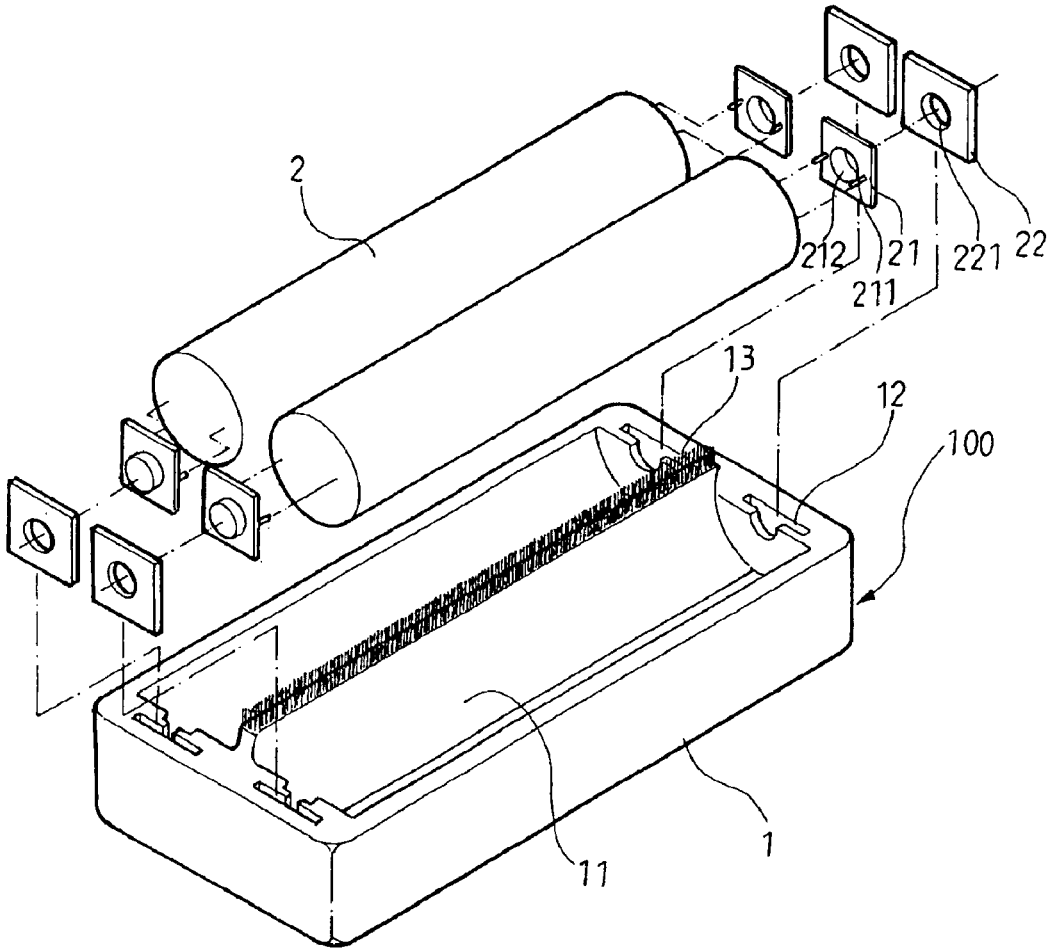
FIG. 2 shows an exploded elevational view of the present invention.
Figure 3:
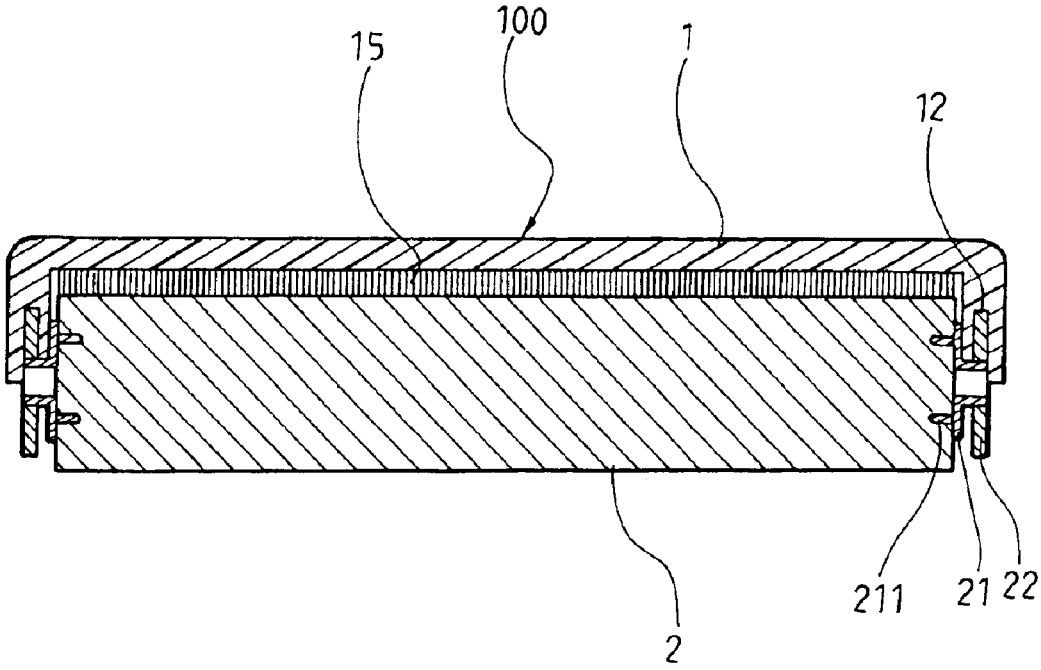
FIG. 3 shows a longitudinal sectional view of the present invention.
Figure 4:
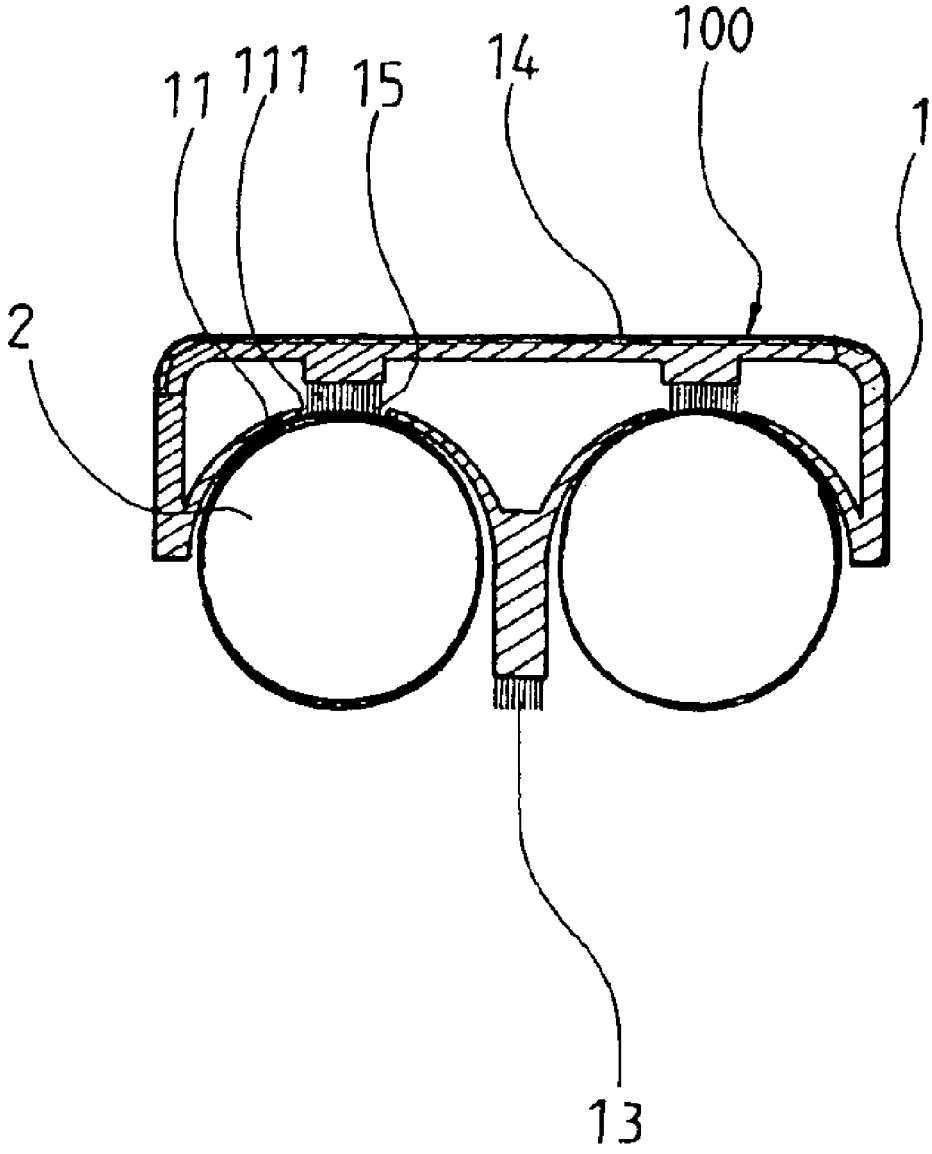
FIG. 4 shows a transverse sectional view of the present invention.

Referring to FIGS. 1–4, which show the blackboard eraser of the present invention comprising a cube 1, wherein two symmetrically arranged semi-cylindrical grooves 11 are defined in a longitudinal direction interior thereof, and a longitudinal groove 111 is further defined underneath each of the semi-cylindrical grooves 11. Two grooves 12 of semicircular and rectangular form are arranged adjacent to each end of the semi-cylindrical grooves 11. An elevated surface having a central brush 13 formed thereon is configured between the two semi-cylindrical grooves 11.

A lid 14 is hinged along a top edge of the cube 1, and when closed forms a closed chamber below the lid 14 and above the two semi-cylindrical grooves 11. Equal-length side brushes 15 are affixed to an inner surface of the lid 14 so as to be respectively positioned along each of the longitudinal grooves 111.

In order to keep soft-surfaced rollers 2 properly respectively rolling within the semi-cylinder grooves 11, a shaft 212 is affixed to an end of each roller 2 by symmetric rods 211, with position of each shaft 212 fixed within a central hole 221 of a positioning-washer 22 which is placed in each of the rectangular grooves 12.

When erasing a blackboard with a blackboard eraser 100, chalk dust sticks to the rollers 2 and is carried to the side brushes 15, which wipe the dust off the rollers 2, and the dust falls into the closed chamber. The present invention makes erasing the blackboard more convenient and cleaner, and prevents a dust-cloud from forming. To clean the accumulated dust, the lid 14 is opened, and the dust is emptied out from the chamber. The present invention is indeed an environmental friendly design.

Figure 5:
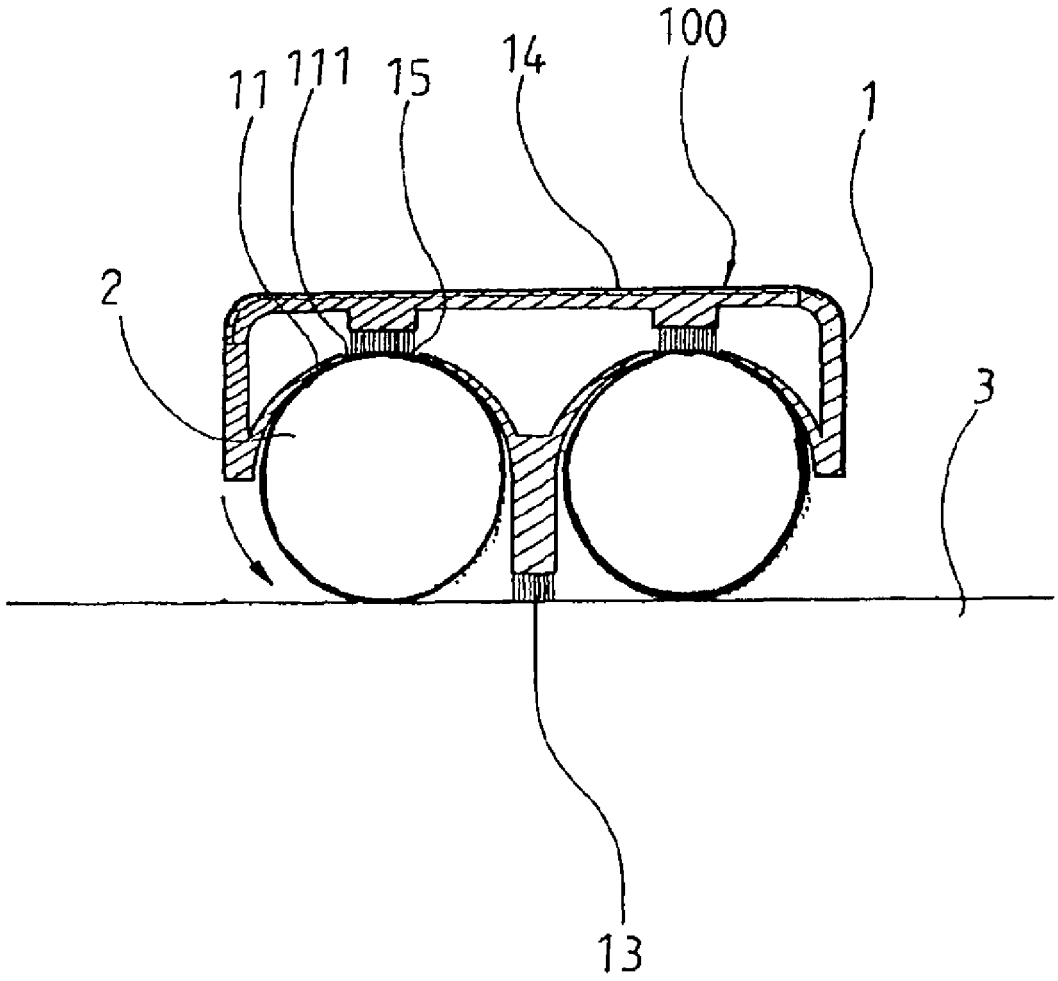
FIG. 5 and FIG. 6 are views illustrating how the present invention works.
Figure 6:
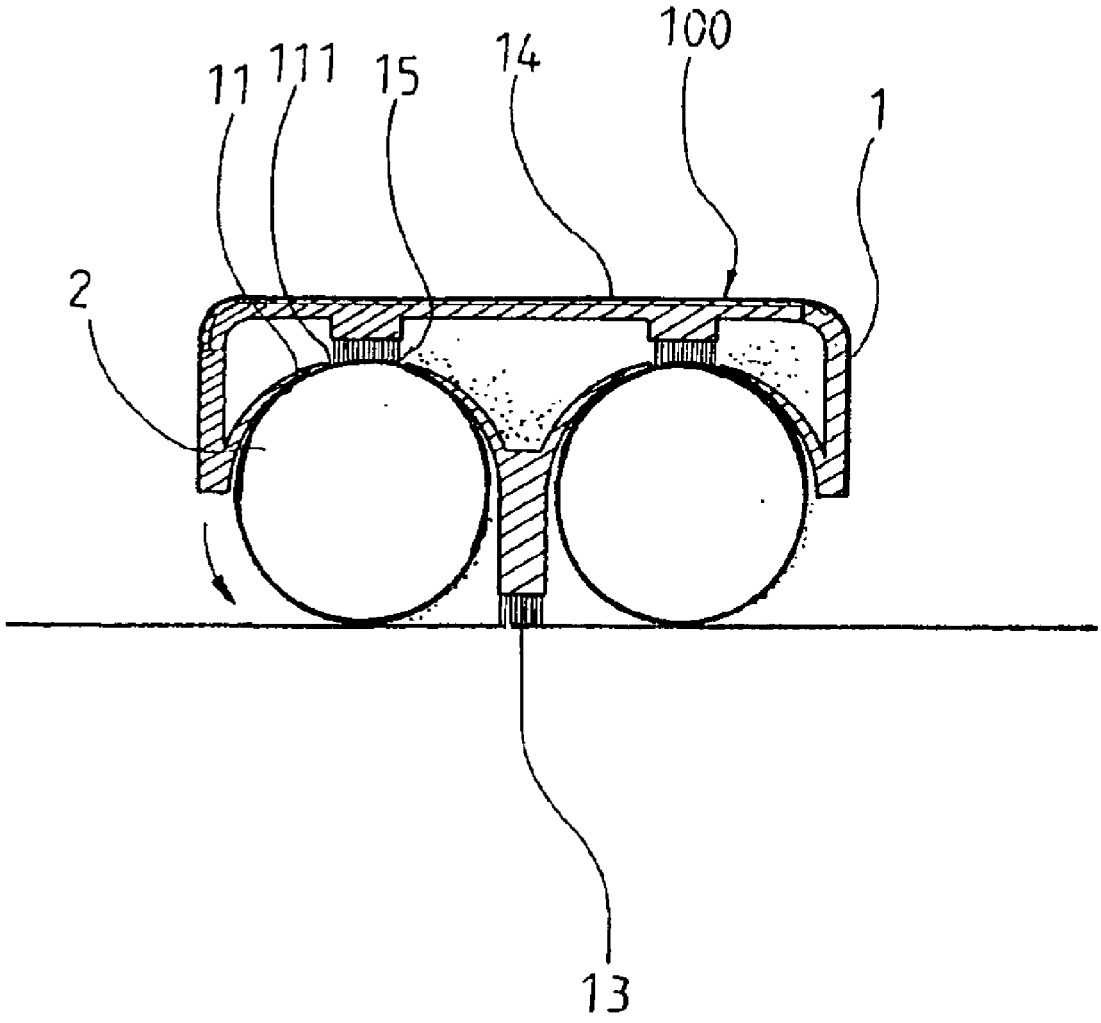

Referring to FIGS. 5 and 6. When using the present invention, the cube 1 is held, and the rollers 2 are moved across a blackboard 3. Chalk dust on the blackboard 3 sticks to the rollers 2 through static electricity generated thereon, and the dust is carried to the side brushes 15, which wipe the dust off rollers 2, and the dust falls into the closed chamber. The central brush 13 between the rollers 2 simultaneously cleans the blackboard, making the blackboard much cleaner.

After a period of time, a user may open the lid 14 and empty out the dust from the chamber, thereby providing for easy cleaning and preventing the dust from flying in the air, which would otherwise cause an environmental pollution issue.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A blackboard eraser comprising:

a cube having two symmetrically arranged semi-cylindrical grooves defined in a longitudinal direction therein, two rectangular grooves are arranged adjacent to each end of the semi-cylindrical grooves, and an elevated surface having a central brush affixed thereon is formed between the two semi-cylindrical grooves; a longitudinal groove is further defined, underneath each of the semi-cylindrical grooves; a lid is disposed on top of the cube, and when closed forms a closed chamber below the lid and above the two semi-cylindrical grooves side brushes are affixed to an inner surface of the lid so as to be respectively positioned along each of the longitudinal grooves;

two soft-surfaced rollers respectively disposed, in the semi-cylindrical grooves;

a shaft-washer, which has a shaft for inserting into a central hole of a positioning-washer, affixed to each end of the rollers by inserting symmetric rods;

the positioning-washer, which has the central hole, placed in the rectangular groove adjacent to each end of the semi-cylindrical grooves;

whereby the shaft-washers and the positioning-washers are respectively disposed in the grooves at each end of the semi-cylindrical grooves, thereby enabling the rollers to rotate freely in the semi-cylindrical grooves; when the blackboard eraser is rolling on a blackboard, chalk dust sticks to the rollers and is carried to the side brushes, the side brushes then wipe the dust, which falls into closed chamber.

* * * * *